US005218902A

United States Patent [19]

Triola

[11] Patent Number: 5,218,902

[45] Date of Patent: Jun. 15, 1993

[54] CAN CRUSHING AND VACUUMING APPARATUS

[76] Inventor: Wayne J. Triola, 30321 Nebula La., Temecula, Calif. 92592

[21] Appl. No.: 874,430

[22] Filed: Apr. 27, 1992

[51] Int. Cl.[5] ..... B30B 9/32; B30B 1/02

[52] U.S. Cl. ..... 100/90; 100/98 R; 100/125; 100/131; 100/293; 100/902

[58] Field of Search ..... 100/90, 98 R, 125, 131, 100/281, 283, 293, 902; 222/87

[56] References Cited

U.S. PATENT DOCUMENTS

| | | | |
|---|---|---|---|
| D. 282,076 | 1/1986 | Taylor | 100/902 X |
| 492,259 | 2/1893 | Barrett | 100/98 R |
| 1,998,263 | 4/1935 | Townsend | 100/98 R X |
| 3,804,004 | 4/1974 | Krebs et al. | 100/98 R |
| 4,228,734 | 10/1980 | Parrish | 100/902 X |
| 4,333,396 | 6/1982 | Longnecker | 100/902 X |
| 4,334,469 | 6/1982 | Tanner et al. | 100/98 R X |
| 4,569,281 | 2/1986 | Woods | 100/902 X |
| 4,696,227 | 9/1987 | Van Buskirk | 100/90 X |
| 5,042,374 | 8/1991 | Klepacki | 100/293 X |

*Primary Examiner*—Stephen F. Gerrity
*Attorney, Agent, or Firm*—Leon Gilden

[57] ABSTRACT

A can crusher apparatus having an end wall plate and a relatively movable press plate selectively directed onto the end wall plate to crush can members therebetween. The end wall plate having longitudinally aligned recesses contained therewithin cooperative with press plate recesses to position can members to be crushed therebetween. A modification of the invention includes vacuum manifold structure to eliminate residual fluids from within can members to be crushed.

5 Claims, 5 Drawing Sheets 11
13
14
15
16
17
18
19
20
21
22
22a 12
23
24
25
26
27
28
29
30
31
32
33
34
35
6
7

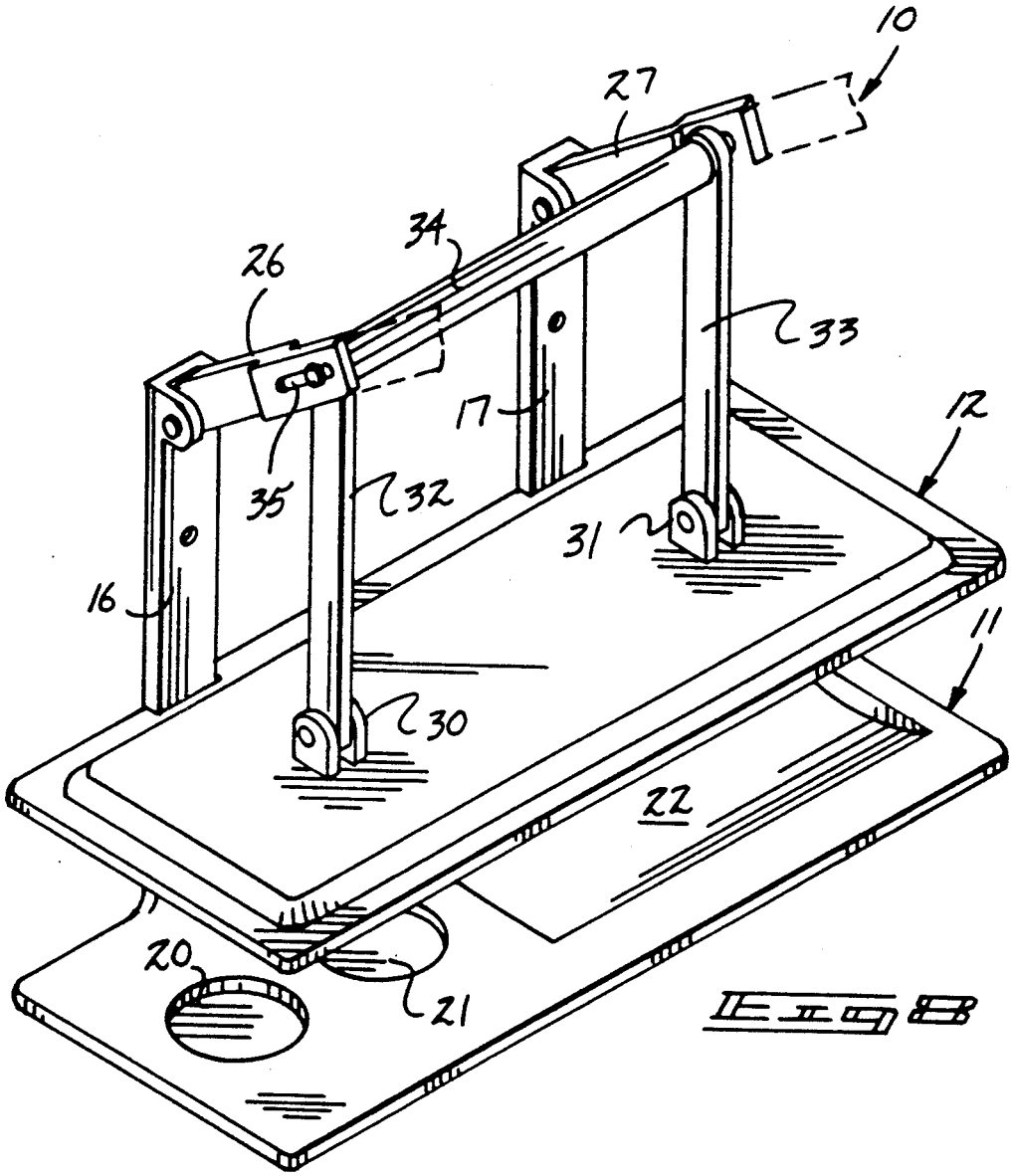
Fig 8
Fig 11
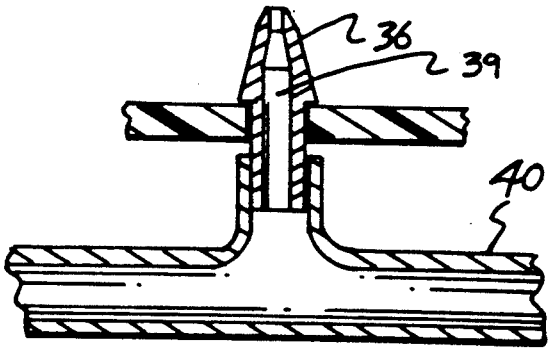

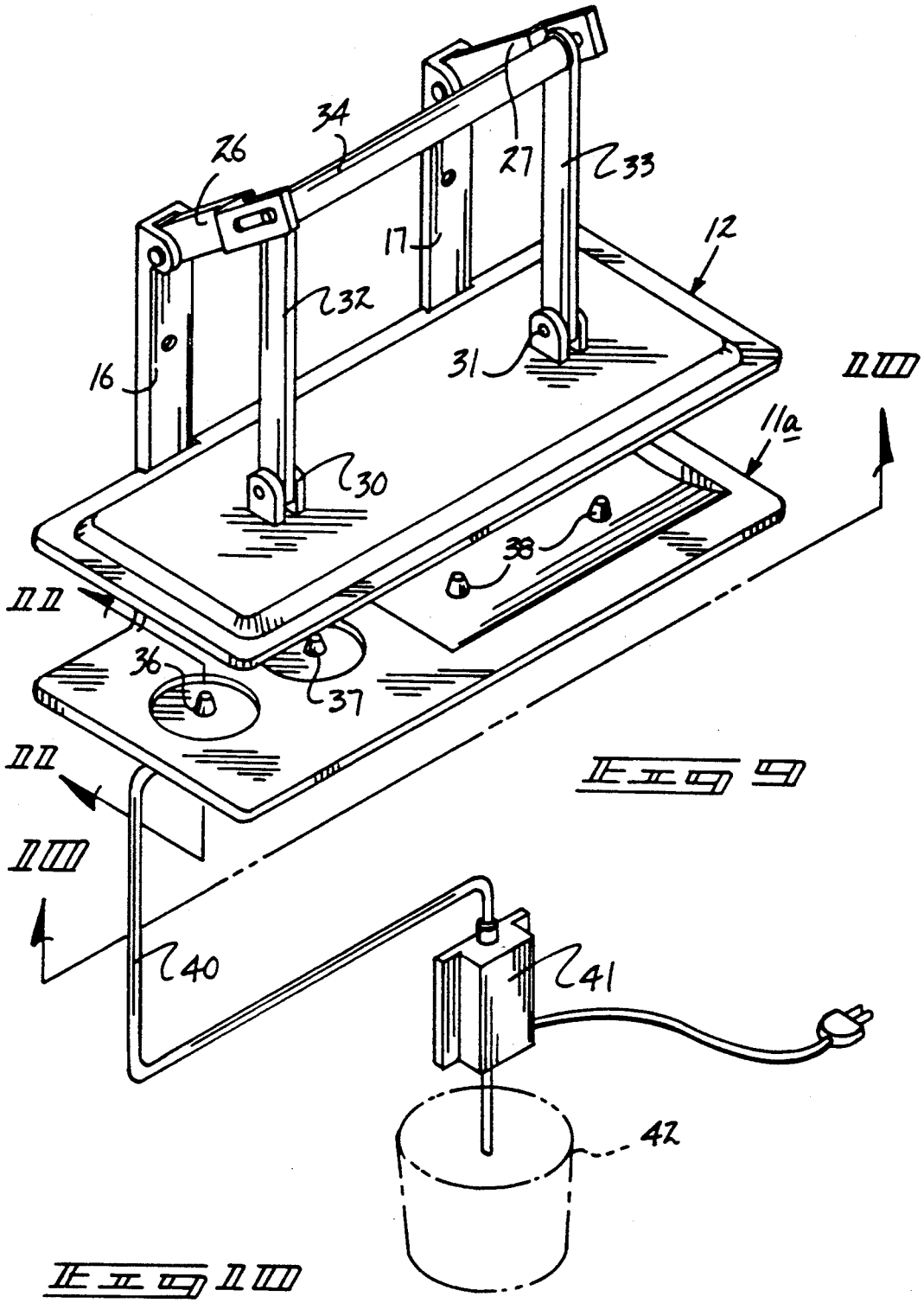
FIG 9
FIG 11
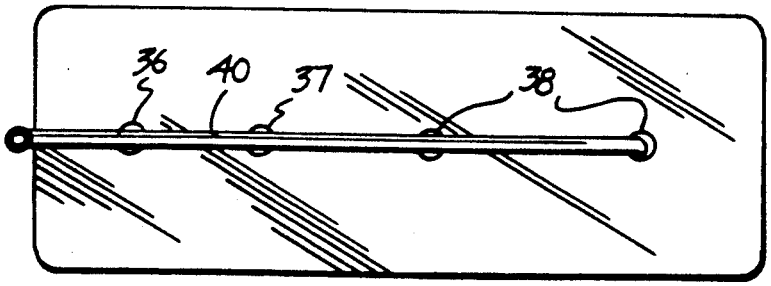

CAN CRUSHING AND VACUUMING APPARATUS

BACKGROUND OF THE INVENTION

1. Field of the Invention

The field of invention relates to can crushing apparatus, and more particularly pertains to a new and improved can crusher apparatus wherein the same is arranged to compactly crush cans or other containers for subsequent recycling.

2. Description of the Prior Art

Various can crushing apparatus is available in the prior art to minimize volumetric storage of such cans prior to their recycling and the like. Such can crushing apparatus is exemplified in the U.S. Pat. No. 4,088,072 to Wittemeier setting forth a can crusher apparatus having selectively directed plate members to crush cans therebetween.

U.S. Pat. No. 4,962,701 to Stralow sets forth a further example of a can crushing structure having a receptacle mounted therebelow.

U.S. Pat. No. 4,722,269 to Watkins set forth a portable can crusher having a hopper to direct cans to a crushing wheel.

U.S. Design Pat. No. 282,076 to Taylor sets forth various configurations of a movable plate relative to a fixed plate to crush can members therebetween.

Accordingly, it may be appreciated that there continues to be a need for a new and improved can crusher apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of can crusher apparatus now present in the prior art, the present invention provides a can crusher apparatus wherein the same is arranged to align and position cans to be crushed between opposing plate members. As such, the general purpose of the present invention, which will be described subsequently in greater detail, is to provide a new and improved can crusher apparatus which has all the advantages of the prior art can crusher apparatus and none of the disadvantages.

To attain this, the present invention provides a can crusher apparatus having an end wall plate and a relatively movable press plate selectively directed onto the end wall plate to crush can members therebetween. The end wall plate having longitudinally aligned recesses contained therewithin cooperative with press plate recesses to position can members to be crushed therebetween. A modification of the invention includes vacuum manifold structure to eliminate residual fluids from within can members to be crushed.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved can crusher apparatus which has all the advantages of the prior art can crusher apparatus and none of the disadvantages.

It is another object of the present invention to provide a new and improved can crusher apparatus which may be easily and efficiently manufactured and marketed.

It is a further object of the present invention to provide a new and improved can crusher apparatus which is of a durable and reliable construction.

An even further object of the present invention is to provide a new and improved can crusher apparatus which is susceptible of a low cost of manufacture with regard to both materials and labor, and which accordingly is then susceptible of low prices of sale to the consuming public, thereby making such can crusher apparatus economically available to the buying public.

Still yet another object of the present invention is to provide a new and improved can crusher apparatus which provides in the apparatus and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 8 is an isometric illustration of the invention.

FIG. 9 is an isometric illustration of a modified anvil plate structure of the invention.

FIG. 10 is an orthographic view, taken along the lines 10—10 of FIG. 9 in the direction indicated by the arrows.

FIG. 11 is an orthographic view, taken along the lines 11—11 of FIG. 9 in the direction indicated by the arrows.

DESCRIPTION OF THE PREFERRED EMBODIMENT

Figure 1:
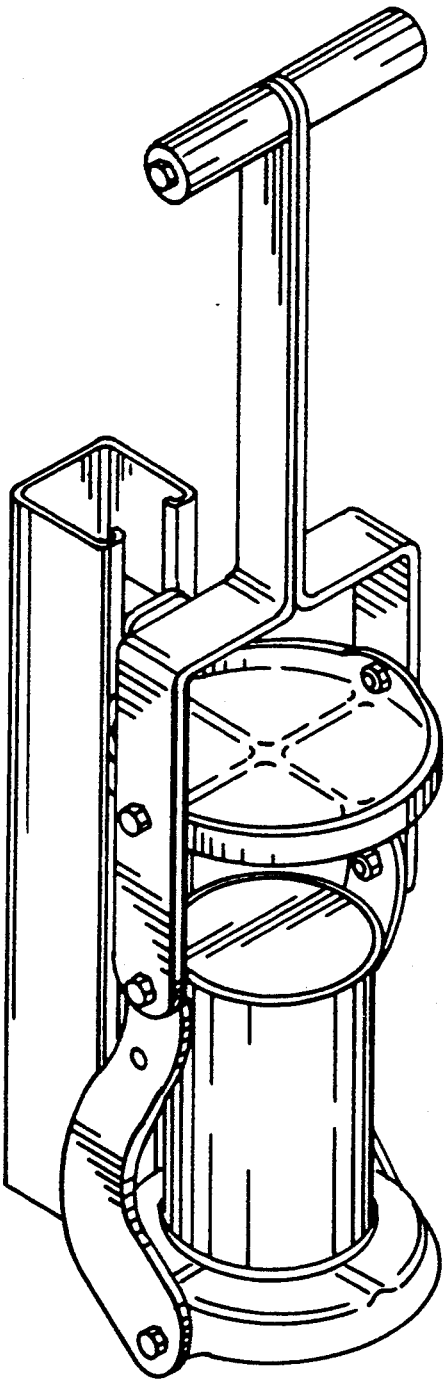
Fig 1 PRIOR ART
FIG. 1 is an isometric illustration of a prior art can crusher structure.

With reference now to the drawings, and in particular to FIGS. 1 to 11 thereof, a new and improved can crusher apparatus embodying the principles and concepts of the present invention and generally designated by the reference numeral 10 will be described.

Figure 2:
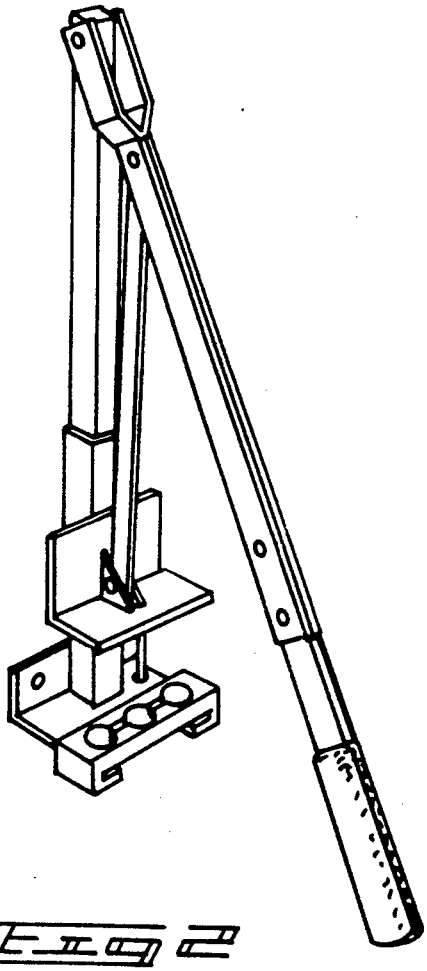
Fig 2 PRIOR ART
FIG. 2 is an isometric illustration of a further prior art can crusher structure.
Figures 2, 3, 4:
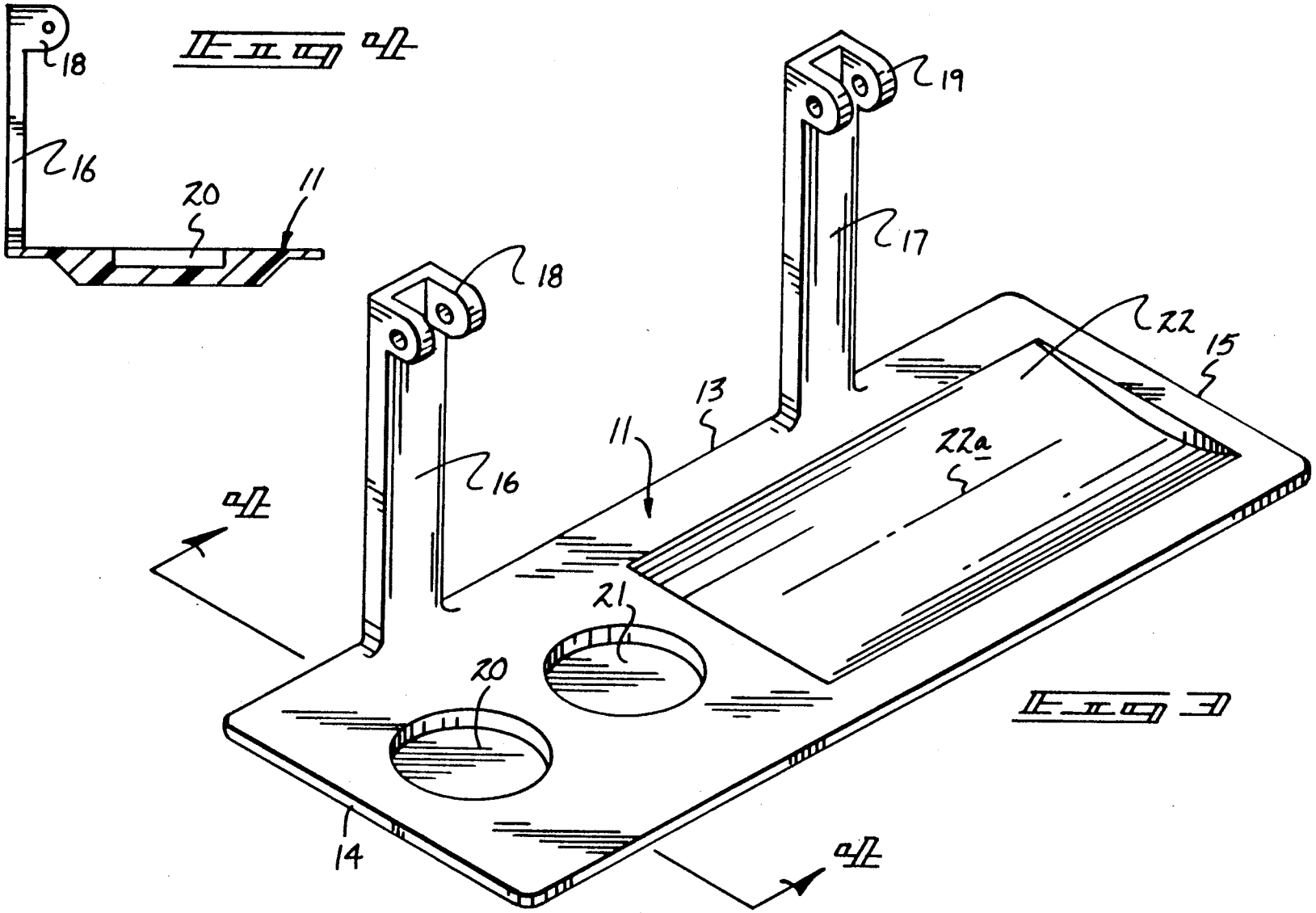
FIG. 3 is an isometric illustration of the anvil plate structure of the invention.
FIG. 4 is an orthographic view, taken along the lines 4—4 of FIG. 3 in the direction indicated by the arrows.

FIG. 1 illustrates a prior art can crusher structure, as set forth in the U.S. Pat. No. 4,088,072 to accommodate a can member between opposing plates. The FIG. 2 illustrates a further prior art structure set forth in Design Pat. No. 282,076.

More specifically, the can crusher apparatus 10 of the instant invention essentially comprises an anvil plate 11, with a press plate 12 movably mounted relative to the anvil plate 11. The anvil plate includes a rear side edge 13 spaced from an anvil plate forward side edge and having an anvil plate first end edge 14 spaced from an anvil plate second end edge 15. A first mounting leg 16 and a second mounting leg 17 arranged in a parallel relationship are orthogonally mounted to the anvil plate at the rear side edge 13. The first and second mounting legs 16 and 17 terminate in respective first and second bifurcated ends 18 and 19. A first and second cylindrical recess 20 and 21 positioned adjacent relative to one another are directed into the top surface of the anvil plate, with an elongate third semi-cylindrical recess 22 directed from the second cylindrical recess 21 to the second end edge 15. The recesses 20–22 are arranged in a longitudinally aligned relationship aligned along the axis 22*a* of the third semi-cylindrical recess 22. In this manner, can members may be vertically crushed or when positioned in the third recess 22, crushed in a parallel relationship relative to a can axis. The recesses further provide positioning of a can member to be crushed.

Figures 4, 5, 6, 7:
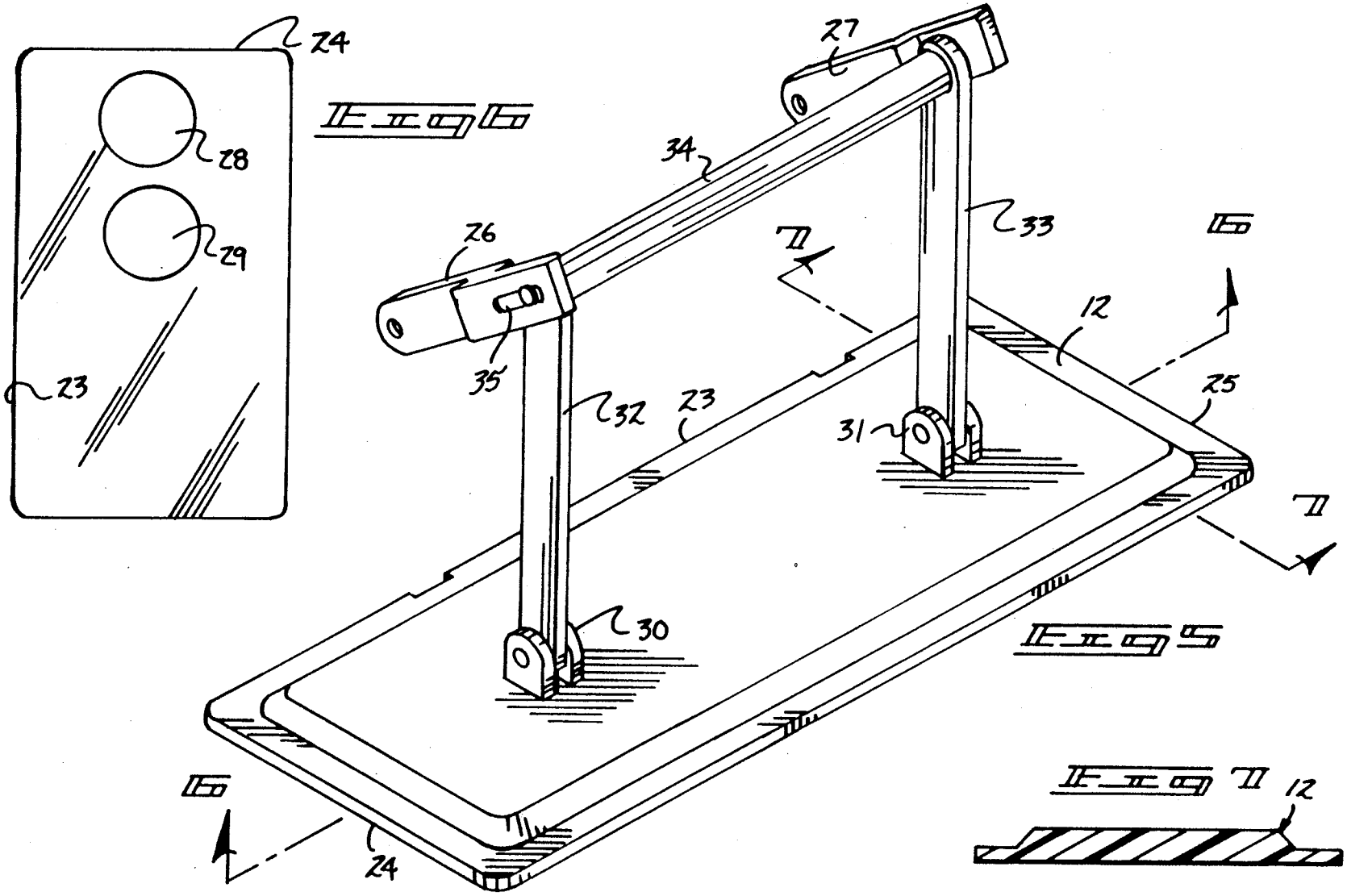
FIG. 5 is an isometric illustration of the press plate structure of the invention.
FIG. 6 is an orthographic view, taken along the lines 6—6 of FIG. 5 in the direction indicated by the arrows.
FIG. 7 is an orthographic view, taken along the lines 7—7 of FIG. 5 in the direction indicated by the arrows.

The FIGS. 5–7 illustrate the press plate structure having a press plate rear side edge 23 spaced from a press plate forward side edge and press plate first and second end edges 24 and 25. A first pivot leg 26 and a second pivot leg 27 are respectively and pivotally received within the first and second bifurcated ends 18 and 19 at lower distal ends of each pivot leg 26 and 27. As illustrated in FIG. 6, the press plate includes first and second cylindrical recesses 28 and 29 that are coaxially aligned with the anvil plate's first and second cylindrical recess 20 and 21 when the press plate is in a parallel relationship to the anvil plate in a can crushing procedure. In this manner, can members in the first and second cylindrical recesses of each of the anvil and press plates are maintained in an aligned relationship. A can positioned within the third semi-cylindrical recess 22 is adequately maintained and does not require a cavity within the press plate. Further, it should be noted that the longitudinally aligned relationship of the recesses permit simultaneous crushing of a plurality of such can members.

First and second bifurcated press plate bosses 30 and 31 pivotally mount at lower distal ends respective first and second press plate legs 32 and 33. The press plate legs 32 and 33 extend upwardly and are orthogonally mounted to connecting leg 34. The connecting leg 34 has its ends received within a pivot leg slot 35 of each of the first and second pivot legs 26 and 27. In this manner, sliding engagement of the press plate legs 32 and 33 maintains alignment of the press plate relative to the anvil plate in a can crushing procedure.

The FIGS. 9–11 illustrate a modified anvil plate 11*a* having a respective first and second piercing tip 36 and 37 coaxially directed into the anvil plate's first and second cylindrical recess 20 and 21. A plurality of third piercing tips 38 are directed into the third semi-cylindrical recess 22. Each piercing tip (see FIG. 11) is formed with a vacuum conduit 39 directed therethrough to pierce an associated can simultaneously during a crushing procedure and direct residual fluid within such can through the vacuum conduit 39. The vacuum conduits 39 are directed into a vacuum manifold 40 positioned below the anvil plate, with a vacuum pump 41 in pneumatic communication with the vacuum manifold 40. A receptacle 42 positioned below the vacuum pump receives the excess fluid thusly obtained through the vacuuming procedure. In this manner, excess fluid is drained to minimize attracting various insects into storage of cans that have been crushed awaiting further processing.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A can crusher apparatus, comprising:

anvil plate and a press plate, with the anvil plate having an anvil plate rear side edge spaced from an anvil plate forward side edge, an an anvil plate first end edge spaced from an anvil second end edge, and an anvil plate top surface spaced from an anvil plate bottom surface;

a first mounting leg and a second mounting leg each fixedly and orthogonally mounted to the anvil plate rear side edge extending upwardly thereof, with the first mounting leg and the second mounting leg arranged in a parallel coextensive relationship;

the first mounting leg terminating in a first bifurcated end, the second mounting leg terminating in a second bifurcated end;

the press plate having a press plate rear side edge spaced from a press plate forward side edge, a press plate first end edge spaced from a press plate second end edge, and a press plate top surface spaced from a press plate bottom surface, wherein can members are adapted to be positioned upon the anvil plate top surface below the press plate bottom surface;

the press plate including a first pivot leg and a second pivot leg, and the first pivot leg and the second pivot leg arranged in a parallel coextensive relationship, with the first pivot leg pivotally mounted within the first bifurcated end, and the second pivot leg pivotally mounted within the second bifurcated end;

linkage means for pivotally mounting the first pivot leg and the second pivot leg to the press plate top surface wherein, the press plate bottom surface is directed to the anvil plate top surface upon manually directing the linkage means towards the anvil plate top surface;

the linkage means includes a press plate first bifurcated boss and a press plate second bifurcated boss each fixedly mounted to the press plate top surface, and a first press plate leg having a first upper distal end and a second press plate leg having a second upper distal end pivotally mounted respectively to the press plate first bifurcated boss and the press plate second bifurcated boss, and the first press plate leg slidably mounted to the first pivot leg at the first upper distal end of the first press plate leg, and the second press plate leg slidably mounted to the second pivot leg at the second upper distal end of the second press plate leg.

2. An apparatus as set forth in claim 1 including a connecting leg fixedly and orthogonally mounted between the first press plate leg and the second prss plate leg to maintain spacing of the first press plate leg relative to the second press plate leg.

3. An apparatus as set forth in claim 2 wherein the anvil plate top surface includes at least a first cylindrical recess and a second cylindrical recess, and an elongate third semi-cylindrical recess, wherein the first cylindrical recess, the second cylindrical recess, and the elongate third semi-cylindrical recess are longitudinally aligned.

4. An apparatus as set forth in claim 3 wherein the press plate bottom surface includes a press plate first cylindrical recess and press plate second cylindrical recess coaxially aligned with the first cylindrical recess and the second cylindrical recess of the anvil plate, wherein the press plate is arranged in a parallel overlying relationship relative to the anvil plate.

5. An apparatus as set forth in claim 4 wherein the anvil plate first cylindrical recess, the anvil plate second cylindrical recess, and the anvil plate elongate third semi-cylindrical recess each include a piercing tip directed therethrough, each piercing tip including a vacuum conduit directed coextensively through the piercing tip, and each vacuum conduit in pneumatic communication with a vacuum manifold positioned below the anvil plate, and a vacuum pump in pneumatic communication with the vacuum manifold to direct vacuum through the vacuum manifold, each vacuum conduit and each piercing tip, and a receptacle positioned below the vacuum pump for receiving fluid from each piercing tip directed through the vacuum pump for deposit into the receptacle.

* * * * *